US005485056A

United States Patent [19]

Sasaki et al.

[11] Patent Number: 5,485,056

[45] Date of Patent: Jan. 16, 1996

[54] MONITORING DEVICE

[75] Inventors: Masahiko Sasaki; Hideo Hatada, both of Kanagawa, Japan

[73] Assignee: Sony Corporation, Tokyo, Japan

[21] Appl. No.: 988,176

[22] Filed: Dec. 9, 1992

[30] Foreign Application Priority Data

Dec. 14, 1991 [JP] Japan ..... 3-352116

[51] Int. Cl.[6] ..... G09G 1/04

[52] U.S. Cl. ..... 315/8; 315/85; 315/370

[58] Field of Search ..... 315/85, 8, 370

[56] References Cited

U.S. PATENT DOCUMENTS

| | | | |
|---|---|---|---|
| 4,634,930 | 1/1987 | Toshiyasu et al. | 315/8 |
| 5,017,832 | 5/1991 | Takita | 315/8 |
| 5,151,635 | 9/1992 | Cappels | 315/370 |
| 5,157,308 | 10/1992 | Rindal | 315/85 |
| 5,198,729 | 3/1993 | Powell | 315/8 |
| 5,243,262 | 9/1993 | Moen | 315/8 |

FOREIGN PATENT DOCUMENTS

| | | |
|---|---|---|
| 235863 | 9/1987 | European Pat. Off. . |
| 348205 | 12/1989 | European Pat. Off. . |
| 500349 | 8/1992 | European Pat. Off. . |
| 523741 | 1/1993 | European Pat. Off. . |

OTHER PUBLICATIONS

IBM Technical Disclosure Bulletin, "Cancellation of Leaked Magnetic Flux", vol. 30, No. 2, May 1988.

*Primary Examiner*—Robert J. Pascal
*Assistant Examiner*—Michael B. Shingleton
*Attorney, Agent, or Firm*—Jay H. Maioli

[57] ABSTRACT

In a monitoring device which forms a display image by using a cathode ray tube, leakage of electric field from the front side of the cathode ray tube is diminished with a simple construction. A leakage electric field compensation electrode is disposed to surround the display area of the front face of a cathode ray tube, a leakage electric field compensation signal, the level of which corresponds to fly-back pulse, is applied to this electrode, and the electric field compensation electrode corresponding forms a compensating electric field that cancels the leakage electric field.

6 Claims, 3 Drawing Sheets

FIG. 4A
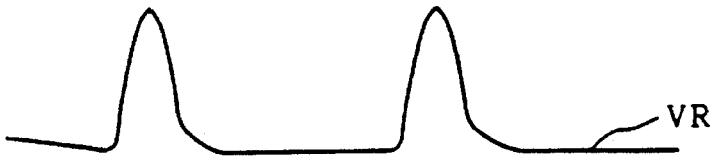
FIG. 4B
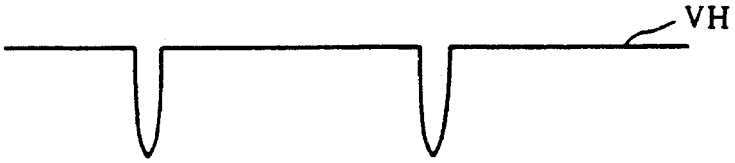
FIG. 4C
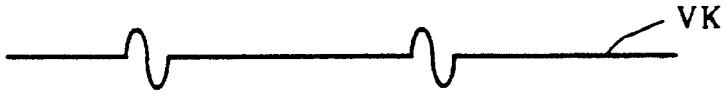
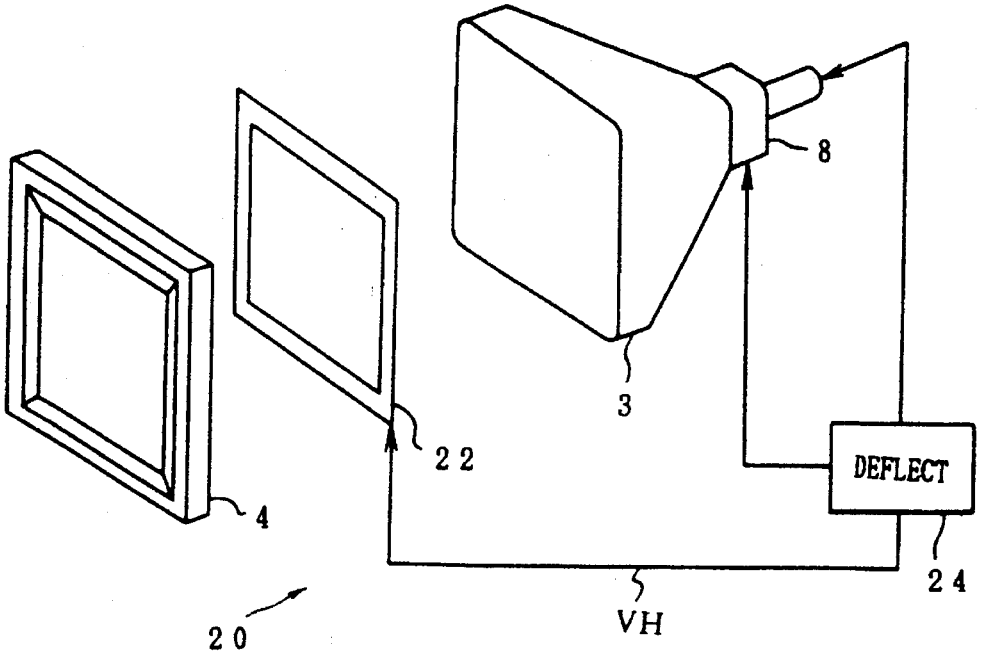
FIG. 5

MONITORING DEVICE

BACKGROUND OF THE INVENTION

1. Field of the Invention

This invention relates to a monitoring device, and more particularly to an improvement of monitoring device for forming display pictures by using a cathode ray tube.

2. Description of the Prior art

Conventionally, a monitoring device using a cathode ray tube has electric shields on the lateral and rear sides of the cathode ray tube for the purpose of reducing unnecessary radiation, thereby maintaining the leakage of magnetic and electric fields to level below specific standard levels.

However, leakage of electric field cannot be completely avoided by mere shielding of the lateral and rear sides of the cathode ray tube.

In particular, in the leakage of electric field, there is much unnecessary radiation from a screen of the cathode ray tube where the screen is not shielded. For instance, an A.C. electric field in the form of fly-back back pulses is detected when measured by, for example, a tabular electrode D which is placed in front of the monitoring device M as shown in FIG. 1.

The leakage of electric field is preferably diminished, considering undesirable effects on human health caused by such electric field.

An effective countermeasure is to provide a conductive coating on the surface of the cathode ray tube, and where the coating is grounded so as to reduce the leakage of electric field from the front face of the cathode ray tube.

This countermeasure, however, requires a special transparent conductive paint, and involves a problem that it costs too much, in regard to practicalness when mass production of the monitoring devices is considered.

It has also been proposed to use a conductive filter at the front side of a CRT in place of the conductive coating. However, this countermeasure uses extra special parts, and therefore also involves problems in regard to practicalness.

Still another solution is to use an antenna electrode disposed in the monitoring device and capable of generating an A.C. electric field so that the electric field leaked is canceled at the source of such electric field.

This method also is impractical due to employment of high voltage applied to the above-mentioned electrode, which causes danger while in service.

SUMMARY OF THE INVENTION

In view of the foregoing, an object of this invention is to provide a monitoring device which is simple in construction but yet capable of reducing leakage of electric field from the front side of a cathode ray tube.

The foregoing object and other objects of the invention have been achieved by the provision of monitoring device 1 which forms a desired display picture by using a cathode ray tube 3, comprising: an electric field forming electrode 2 arranged to surround a display area of the front face of the cathode ray tube 3; and a compensation signal generating means 10 for generating leakage electric field compensation signal VH, the level of which varies in relation to a fly-back pulse, and for supplying the leakage electric field compensation signal VH to the electric field forming electrode 2; whereby any leak of electric field from the cathode ray tube is canceled by the electric field formed by the electric field forming electrode 2.

According to the invention, a position to be disposed and a configuration of a compensating electric field forming electrode 2 is devised, so that the electric field forming electrode 2 is arranged to surround the display picture area of the front face of the cathode ray tube 3, and the leakage electric field compensation signal VH the level of which varies in relation to a fly-back pulse is applied thereto, whereby the electric field forming electrode 2 forms an electric field which acts to cancel any leak of electric field from the cathode ray tube 3.

According to the present invention, it is possible to obtain a monitoring device in which leakage of electric field is diminished by a simple structure including a leakage electric field compensation electrode which is arranged to surround the display picture area of a cathode ray tube and which receives a leakage electric field compensation signal the level of which varies in relation to the fly-back pulse.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIGS. 4A to 4C are signal waveform diagrams for the explanation of the operation of the pickup unit;

FIG. 5 is a schematic diagram showing a second embodiment of the monitoring device in accordance with the present invention.

DETAILED DESCRIPTION OF THE INVENTION

Preferred embodiments of this invention will be described with reference to the accompanying drawings:

(1) First Embodiment

Figure 2:
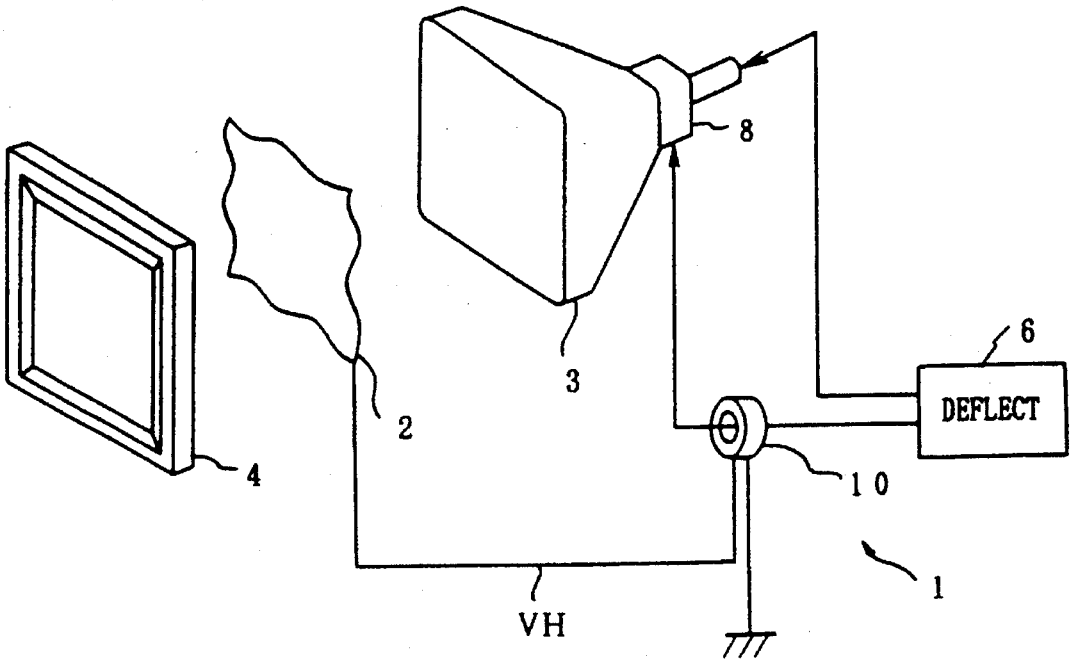
FIG. 2 is a schematic diagram showing an embodiment of the monitoring device in accordance with the present invention.

Referring to FIG. 2, 1 generally designates a monitoring device having a cabinet, with a leakage electric field compensation electrode 2 disposed inside the cabinet near the front side of the cabinet.

The leakage electric field compensation electrode 2 is formed by a lead wire which is laid in loop-like fashion so as to surround the display area of the cathode ray tube 3, at the inner side of the outer frame 4 (this is formed by so-called bezel) on the screen side of the cathode ray tube 3, and is fixed to the outer frame 4 by means of a predetermined lead wire supporting member.

Thus, the leakage electric field compensation electrode 2 is held without making direct contact with the cathode ray tube 3, in such a manner as not to interfere with the cathode ray tube 3 when the former is mounted.

The cathode ray tube 3 is covered by a shield plate (not shown in figure) over its portion from the neck portion to the portion near the outer frame so as to be shielded, thus reducing the unnecessary radiation to the level below a predetermined level.

Meanwhile, a deflecting circuit 6 generates power for driving the cathode ray tube 3 and drives a horizontal deflecting yoke 8, thereby deflecting an electron beam of the cathode ray tube 3 to display an picture.

Furthermore, in this embodiment, the monitoring device 1 has a pickup device 10 which picks up a current flowing into a lead 18 which carries a driving signal to the horizontal deflecting yoke 8, and applies the picked up driving signal after amplifying it to the leakage electric field compensation electrode 2 to cancel the leakage electric field.

Figure 3:
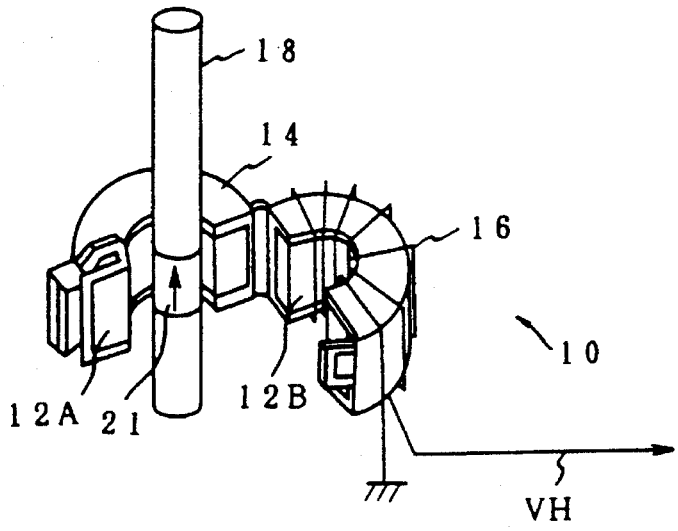
FIG. 3 is a perspective view of a pickup unit of the monitoring device shown in FIG. 2.

As shown in FIG. 3, the pickup unit 10 includes a ring-shaped core which is split into two halves 12A and 12B received in respective halves of a case 14. The arrangement is such that the core halves 12A and 12B are united to form the ring-shaped core when two halves of the case are brought together to close the case.

The pickup unit 10 has a winding 16 of a predetermined number of turns provided on the case half so that a magnetic transformer is made up in which the magnetic flux circulating through the ring-shaped core 12A and 12B are detected by the winding 16.

The pickup unit 10 is so arranged that the cold side lead line 18 supplying the driving signal for the horizontal deflecting yoke 8 passes the center of the ring-shaped core 12A and 12B, thus picking up the driving signal for the horizontal deflecting yoke 8.

The cold side lead line 18 is provided with a direction indicating seal 21 wound around the lead, in order that this lead line can be discriminated from the hot-side lead line and that the pickup unit 10 can be mounted at a correct position and in a correct direction.

Then, as shown in FIGS. 4A to 4C, the leakage electric field VR radiates in the same pattern as the fly-back pulse at the front side of the cathode ray tube 3 (FIG. 4A), and the level of the driving signal VH picked up from the cold-side lead line of the horizontal deflecting yoke 8 varies in accordance with the fly-back pulse (FIG. 4B), whereby the leakage electric field is canceled by the driving signal VH applied to the leakage electric field compensation electrode 2 in reverse phase to the leakage electric field VR.

More specifically, an experiment showed that, when the number of turns of the winding 16 is set to 20 and the driving signal VH of about 20 (Vp–p) was applied to the leakage electric field compensation electrode 2, the remained leakage electric field VK is reduced substantially to zero (FIG. 4C).

It will be understood that the leakage of electric field is effectively diminished by a simple structure which employs the leakage electric field compensation electrode 2 formed of a wire and arranged inside of the outer frame 4 and the pickup unit 10, without requiring any change in the circuit board and other parts.

In general, a known monitoring device has a characteristic that the level of the leakage electric field is largely changed due to variation in the horizontal deflecting current which is caused by a change in the size of the picture frame in the horizontal direction.

In the described embodiment, since the driving signal for the horizontal deflecting coil is picked up, the compensation electric field generated by the leakage electric field compensation electrode 2 is changed by an amount in proportion to the amount of variation in the leakage electric field caused by a change in the picture frame size, thereby preventing variation without adjusting the intensity of the leakage electric field.

According to the described arrangement, leakage of the electric field from a cathode ray tube can be canceled by an electric field formed by a leakage electric field compensation electrode which is constituted by a lead wire laid around the display area of the front face of the cathode ray tube and which receives picked up driving signal for the horizontal deflecting coil, thus making it possible to reduce the leakage of electric field from the monitoring device by a simple structure.

(2) Second Embodiment

Referring to FIG. 5 which employ the same reference numerals as those in FIG. 2 to depict corresponding portions, numeral 20 generally designates another embodiment of the monitoring device which employs a leakage electric field compensation electrode 22 which is formed by processing an aluminum board and sheet into frame-like form, shaped like a metal plate plated bezel 4. Instead of the leakage electric field compensation electrode 22, a structure in which the bezel 4 is plated with metal may be used.

Figure 1:
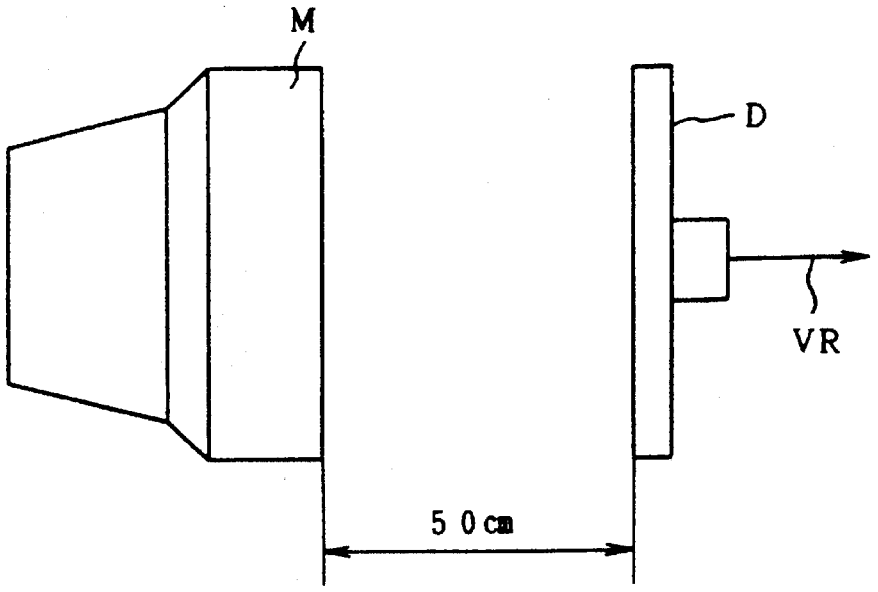
FIG. 1 (PRIOR ART)
FIG. 1 is a schematic diagram for the explanation of a method for measuring leakage electric field.
Figure 6:
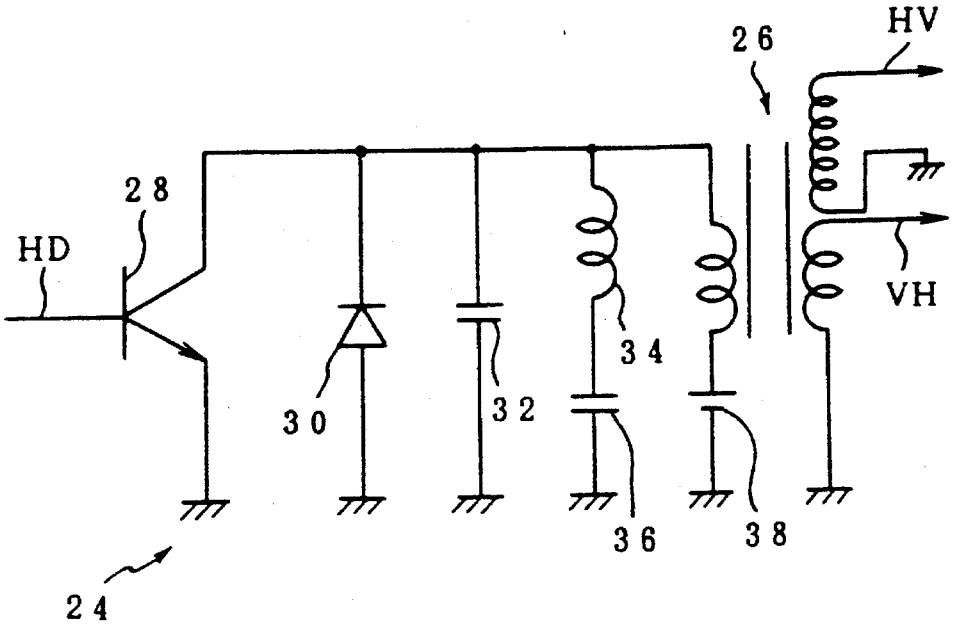
FIG. 6 is a connection diagram representing a deflecting circuit used in the second embodiment.

Furthermore, in this embodiment, shown in FIG. 6, the output VH of the secondary winding 26C of a fly-back transformer of a deflecting circuit 24 is applied to the leakage electric field compensation electrode 22 as a driving signal, thereby canceling the leakage electric field.

More specifically, in the deflecting circuit 24, connected to the collector of a horizontal output transistor 28 are a damper diode 30, a resonance capacitor 32, a series connection of a horizontal deflecting coil 34 and an S-correction capacitor 36, and the primary winding 26A of a fly-back transformer 26, so that the power from a power supply 38 is supplied through the fly-back transformer 26. At the same time, the horizontal output transistor 28 is driven by a horizontal synchronizing signal HD.

According to the described arrangement, the deflecting circuit 24 produces a high voltage HV for driving the cathode ray tube 3, at a secondary winding 26B of the fly-back transformer 26, as well as other voltages, and supplies the horizontal deflecting yoke 8 with a deflecting current, thereby driving the cathode ray tube 3. At the same time, the deflecting circuit 24 obtains, from the secondary winding 26C of the fly-back transformer 26, a driving signal VH the level of which varies in relation to the fly-back pulse. In this embodiment, the driving signal VH is applied to the leakage electric field compensation electrode 22 in reverse phase.

Thus, the arrangement shown in FIG. 5 provides an effect equivalent to that of the first embodiment through the leakage electric field compensation electrode which receives the output from the secondary winding 26C of the fly-back transformer.

(3) Other Embodiments

The embodiments as described employs the driving signal for the horizontal deflecting yoke or the output from the secondary winding of the fly-back transformer. These arrangements, however, are only illustrative. For instance, when a driving circuit for the horizontal deflecting yoke and a high-voltage generating circuit are constructed independently of each other, the driving signal may be supplied from a dummy yoke provided in the high-voltage generating circuit, instead of the horizontal deflecting coil.

It is also to be understood that the shape and type of the leakage electric field compensation electrode can have wide selections, e.g., use of various metallic sheets, although a lead wire and a frame of an aluminum sheet are used in the described embodiments.

While there the invention has been described in connection with the preferred embodiments of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A monitoring device which displays an image by cathode ray tube, comprising:

an electric field forming electrode arranged to surround completely outer edges of a display area of a front face of said cathode ray tube for forming a compensating electric field;

compensation signal generating means for generating a leakage electric field compensation signal, including a magnetic coupling means for detecting a horizontal drive signal, the signal level of said leakage electric field compensation signal varies corresponding to a change in said horizontal drive signal and has a reversed phase relative thereto; and compensation signal supplying means for supplying said leakage electric field compensation signal from said compensation signal generating means to said electric field forming electrode, wherein leakage of an electric field from said cathode ray tube is canceled by the compensating electric field formed by said electric field forming electrode.

2. The monitoring device according to claim 1, wherein:

said electric field forming electrode includes a lead wire in a loop arrangement laid around said display area of the front face of said cathode ray tube, and said magnetic coupling means detects the horizontal drive signal for a horizontal deflecting yoke from a lead line of the horizontal deflecting yoke and said compensation signal generating means generates said leakage electric field compensation signal based on said horizontal drive signal for the horizontal deflecting yoke.

3. The monitoring device according to claim 1, wherein:

said electric field forming electrode is formed by a lead wire covered with an insulating material and is fixed to an inner side of a front face of a bezel arranged to surround said display area.

4. The monitoring device according to claim 1, wherein:

said electric field forming electrode is formed by a square metallic board with frame-like form and is fixed to an inner side of a front face of a bezel arranged to surround said display area.

5. The monitoring device according to claim 1, wherein:

said compensation signal generating means is a secondary winding of a fly-back transformer.

6. The monitoring device according to claim 1, wherein:

said electric field forming electrode is a plated, metallic layer plated around a front face of a bezel arranged to surround said display area.

* * * * *

UNITED STATES PATENT AND TRADEMARK OFFICE

CERTIFICATE OF CORRECTION

PATENT NO. : 5,485,056
DATED : January 16, 1996
INVENTOR(S) : Masahiko Sasaki and Hideo Hatada It is certified that error appears in the above-indentified patent and that said Letters Patent is hereby corrected as shown below:

Col.4, line 19, delete "plate"
Col.5, line 1, delete "there" to --invention--

In the claims:
Col.5, line 9, after "by" insert --a--

Signed and Sealed this
Thirtieth Day of June, 1998

*Attest:*

*Attesting Officer*

BRUCE LEHMAN

*Commissioner of Patents and Trademarks*